US008704622B2

(12) United States Patent
Koepsell

(10) Patent No.: US 8,704,622 B2
(45) Date of Patent: Apr. 22, 2014

(54) SWITCH ARRANGEMENT

(71) Applicant: Johnson Electric S.A., Murten (CH)

(72) Inventor: Martin Koepsell, Ennepetal (DE)

(73) Assignee: Johnson Electric S.A., Murten (CH)

( * ) Notice: Subject to any disclaimer, the term of this patent is extended or adjusted under 35 U.S.C. 154(b) by 0 days.

(21) Appl. No.: 13/861,075

(22) Filed: Apr. 11, 2013

(65) Prior Publication Data

US 2013/0271246 A1 Oct. 17, 2013

(30) Foreign Application Priority Data

Apr. 11, 2012 (DE) ..... 10 2012 007075

(51) Int. Cl.
*H01H 9/00* (2006.01)

(52) U.S. Cl.
USPC ..... 335/207; 335/205

(58) Field of Classification Search
USPC ..... 335/205–207
See application file for complete search history.

(56) References Cited

U.S. PATENT DOCUMENTS 3,739,117 A * 6/1973 Melton ..... 200/61.1
7,924,124 B2 * 4/2011 Leipold et al. ..... 335/177

* cited by examiner

*Primary Examiner* — Ramon Barrera
(74) *Attorney, Agent, or Firm* — Muncy, Geissler, Olds & Lowe, P.C.

(57) ABSTRACT

A switch arrangement for electric currents has at least two contacts to be closed and opened. At least one of the contacts is formed by sections of an electrically conductive pathway of a foil. At least one magnet assigned to the foil. At least one magnetic component is placeable in the magnetic field of the magnet and facing the magnet on the other side of the foil. When the magnetic body is placed in the magnetic field of the magnet it is attracted to the magnet causing the foil to be squeezed and the contacts to make contact, closing the switch.

20 Claims, 2 Drawing Sheets

SWITCH ARRANGEMENT

CROSS REFERENCE TO RELATED APPLICATIONS

This non-provisional patent application claims priority under 35 U.S.C. §119(a) from Patent Application No. 102012007075.6 filed in Germany on Apr. 11, 2012, which is incorporated herein by reference.

FIELD OF THE INVENTION

This invention relates to a switch arrangement and in particular, to a switch arrangement having at least two switchable contacts and at least one of the contacts is formed by sections of an electric pathway of a foil.

BACKGROUND OF THE INVENTION

Switch arrangements of the species mentioned in the preceding are known for a variety of applications. A switch has at least two contacts, which may be positioned in contact with one another and opened. When they are in contact, an electrically conductive flow is established across the switch. Short circuiting may then occur when the two contacts themselves approach one another.

Besides wire contacts or contacts on printed circuit boards, electric pathways in foils are now commonly used. For example, copper pathways are positioned on plastic supports. Switches can be soldered onto these pathways, but it is also possible to expose sections of the pathways and thus use them directly as switch contacts.

The object of the present invention is to provide a switch arrangement of the species described in the introduction, in which the switch is formed at least in part by a foil for a space-saving switch configuration.

Closing systems in automobiles (doors, tailgate, engine hood and sliding roofs) are a suitable area of application. For manual operation of the closing systems, only switches that include a snap-action mechanism are suitable. By this is meant that when the actuating element is in a certain position the switch jumps automatically—regardless of any (further) movement of the actuating element. According to the prior art, this is achieved with a mechanical tilt-jump mechanism. In slide switches, neutral switching states occur, which are neither open nor closed, depending on the actuation position and actuation speed. They are therefore not suitable for manual operation, but only in conjunction with drive units that rely on external energy, The known tilt-jump mechanisms are not suitable for use in combination with a foil, or they would be very complicated because they are not compatible with the particular properties of foils. With the solution according to the invention, a novel snap-action mechanism is presented that is usable with a switch foil. It is also possible to produce such a switch arrangement with good switching haptics.

SUMMARY OF THE INVENTION

This object is solved according to the invention in that at least one magnet is allocated to the foil and at least one active body is placeable in the magnetic field of the magnet. This active body may be another permanent magnet or a magnetic body such as an iron body.

Accordingly, in one aspect thereof, the present invention provides a switch arrangement for electric currents, comprising: at least two contacts to be closed and opened, wherein at least one of the contacts is formed by sections of an electrically conductive pathway of a foil; at least one magnet assigned to the foil; and at least one active body placeable in the magnetic field of the magnet, wherein the active body is a magnetic component that is placeable facing the magnet on the other side of the foil.

The magnet is preferably a permanent magnet, as this is favourable for the compact construction of the switch arrangement. According to a subsequent refinement of the invention, at least two magnets are present, one magnet being arranged on each side of the foil and the polarities of the two magnets being in the same direction. If two magnets are used, two magnetic fields are available. The active body is formed by the second magnet, and with the polarities of the two magnets aligned in the same direction these two magnets exert a strong attraction on one another. The foil with the contact is arranged between the magnets in such manner that when the magnets move toward one another the foil is taken with them and is moved into contact with a counter contact.

According to a further refinement, it is provided that at least one of the magnets is accommodated so as to be displaceable in a sliding guide. The approach movement of the two magnets may be effected by various elements. Swivelling elements or roller elements may be provided; a sliding guide is used for preference. With a sliding guide, one magnet may be moved closer to or farther away from the other in a sliding motion. When the magnets approach one another, the contact is closed, since the magnets attract one another and are able to draw the foil with them. If one of the magnets is moved away from the other again, the attractive force is broken, and the foil is able to break contact with the counter contact due to its inherent elasticity, so that the electrical circuit is opened again. The sliding guide may preferably have a travel of ≥0.5 mm, so that tolerances in the environment of the switch arrangement may be compensated.

In a further configuration, it is possible for least two magnets to be provided on at least one side of the foil, and for different switch circuits on the foil to be assigned to these magnets. One magnet on the other side of the foil may be may be arranged in the sliding guide and assigned to these two magnets. The sliding guide then serves to assign the magnet to one of the two magnets on the other side, in which case these magnets attract one another and close the associated switch circuit on the foil. The other switch circuit remains open; this second switch circuit can only be closed by moving the magnet towards this switch circuit and the other magnet via the sliding guide.

With regard to the structural design of the sliding guide, a refinement of the invention provides for the sliding guide to have a fixed housing and a slide that is movable inside the housing, wherein the housing and the slider each contain one sliding permanent magnet with the same polarity.

Additional permanent magnets, specifically sliding permanent magnets, are provided in addition to the magnets for switching the foil. These act on the movement of the slider to cause a sliding movement in the housing. The slider may have a starting position, in which the sliding permanent magnets are moved towards each other. Since their polarities are aligned in the same way, in this arrangement they attract one another. Now if the slider is displaced by the application of an external force, it draws the one permanent magnet with it. If the external force on the slider diminishes, this attracted permanent magnet moves the slider back automatically until it reaches the permanent magnet in the housing again and returns to its starting position. A spring or other return arrangement is not needed, and the resetting action by the permanent magnets creates a switching feel that bespeaks reliability and dependability.

The polarity of the permanent magnet in the slider is preferably aligned in the opposite direction to the polarities of the magnets assigned to the foil. If the slider with its permanent magnet approaches the magnets assigned to the foil, the opposite polarities may result in repulsion, and this repulsion may serve to move a magnet towards the foil or away from it.

Finally, for the purposes of a further variant of the invention it is provided that both contacts are formed by sections of electrically conductive pathways within two foils, and that both foils are arranged one on top of the other with an insulating gap between them. This insulating gap is created when the electrical circuit is in the unclosed state; it is removed when at least one magnet and an active body approach one another. The active body and the magnet approach one another, causing the two foils to be trapped between the active body and the magnet, and the contacts come into contact with one another.

Preferably, the magnetic component is a permanent magnet.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
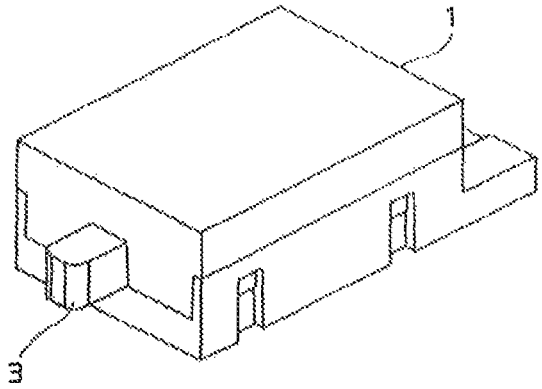
FIG. 1 is a perspective view of a switch arrangement for electrical currents according to the invention.
Figure 2:
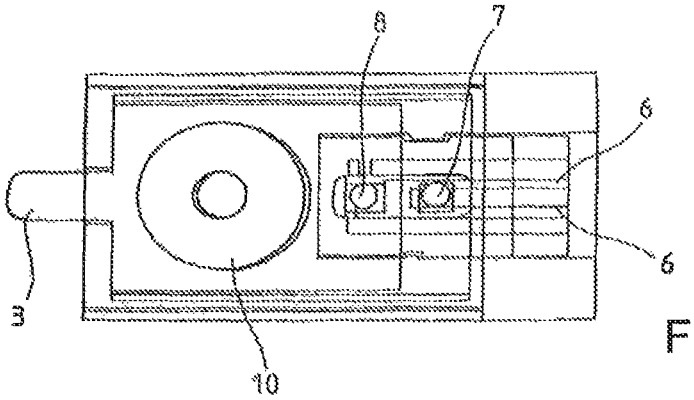
FIG. 2 is a transparent view of the components of the switch arrangement of FIG. 1.
Figure 3:
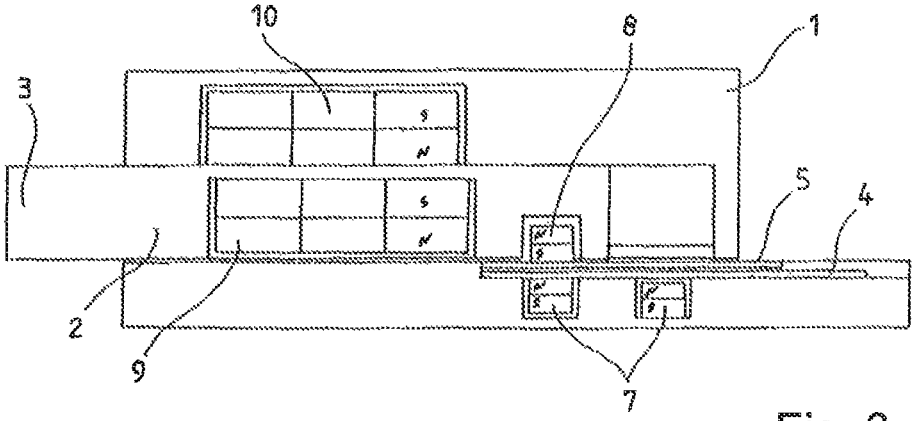
FIG. 3 is a cross-sectional view of the switch arrangement of FIG. 1.

The switch arrangement of FIG. 1 comprises a two-part, cuboid housing 1 having an internal slider 2 (FIG. 3). Slider 2 has an outwardly projecting tappet 3 which is able to enter into operative engagement with other components in such manner as to cause a displacement of slider 2. FIGS. 2 and 3 show that foils 4, 5 with pathways 6 are inserted between the two components of housing 1. Portions of pathways 6 are exposed inside housing 1, such that when they are positioned one directly above the other they complete an electrical circuit between foils 4 and 5.

Two magnets 7 are arranged below foil 4 in housing 1. These magnets 7 are arranged in installation spaces inside housing the installation spaces being slightly higher than the height of each magnet 7. FIG. 3 shows that the magnet 7 on the left is raised while the magnet 7 on the right is resting on the base of the installation space. Magnet 7 on the left is raised by means of another magnet 8 above foil 5. The magnetic fields of magnets 7 and 8 are aligned in the same direction, so that magnets 7 and 8 attract each other. Their attraction causes foils 4 and 5 to be pressed against one another and the contact is closed. The opposite poles of magnets 7, 8 are indicated by N and S in the figures.

The magnets 7, 8 assigned to the foils are of compact design, larger permanent magnets 9, 10 are arranged inside slider 2 and housing 1. The polarities of permanent magnets 9, 10 are aligned in the same direction, so permanent magnets 9, 10 attract one another; permanent magnet 9 is raised in its installation space inside slider 2 and moved towards permanent magnet 10.

Figure 4:
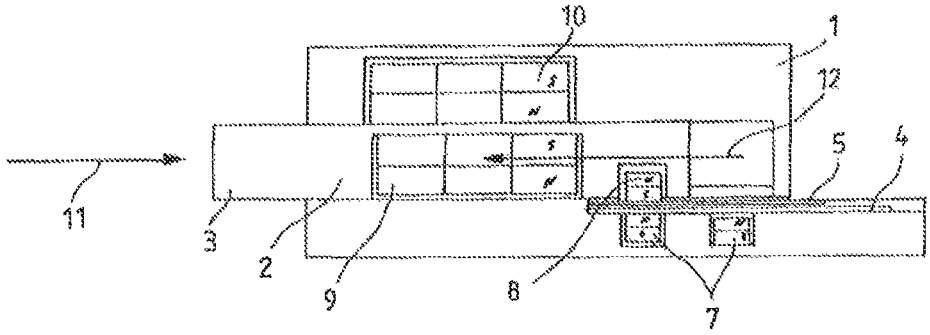
FIGS. 4-6 are further cross-sectional views, similar to FIG. 3, with the switch arrangement in various operating states.

FIG. 4 is similar to FIG. 3. A force from outside acting in the direction of arrow 11 is exerted on slider 2; the force is applied by tappet 3. This external force counteracts a magnetic restoring force in the direction of arrow 12, since permanent magnets 9, 10 attract one another. In the state shown in FIG. 4, a first electrical circuit on foils 4 and 5, which is assigned to permanent magnet 7, is closed.

Figure 5:
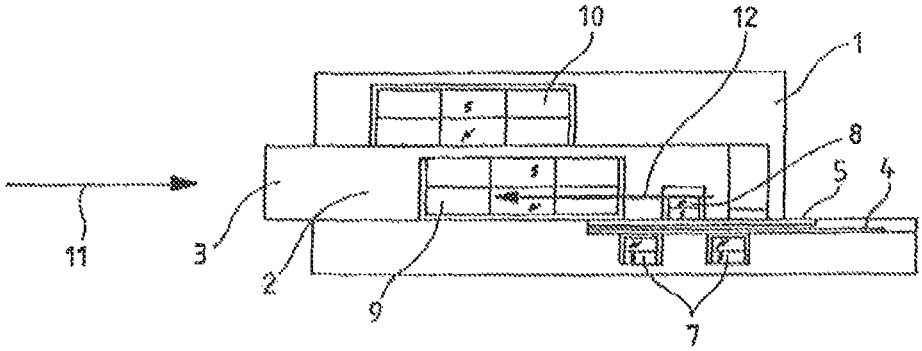

In FIG. 5, slider 2 has been displaced such that magnet 8 is positioned between magnets 7. Both magnets 7 are not in reciprocal engagement with magnet 8, and accordingly this position is an OFF position in which no electrical circuit is completed between foils 4 and 5.

Figure 6:
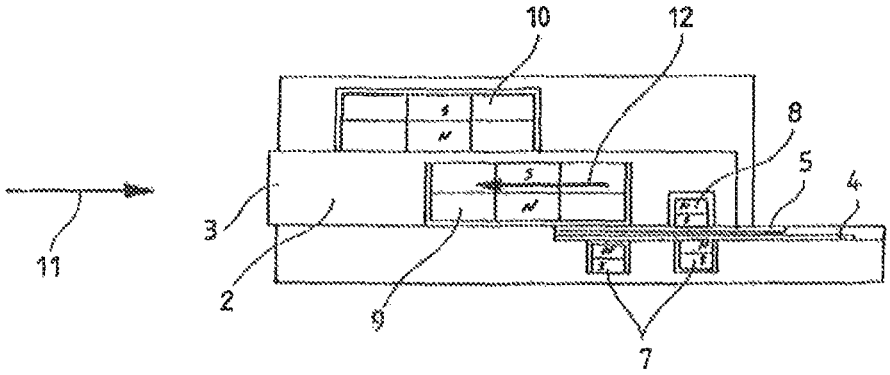

Finally, FIG. 6 shows the position of maximum displacement of slider 2. Magnet 8 has moved closer to magnet 7 on the right, so that now an electrical circuit is completed in this area. By advancing into the area of magnet 7 on the left, permanent magnet 9 in the slider causes the left magnet 7 to move away from foil 4, since the polarities of permanent magnet 9 and magnet 7 are opposite and these magnets 9, 7 repel one another. Foils 4 and 5 move away from another in the area of the magnet 7 on the left due to the inherent elasticity of these foils 4, 5.

FIGS. 4 to 6 show that the external force that must be applied in the direction of arrow 11 diminishes as the displacement of slider 2 becomes greater, and the magnetic restoring force according FIG. 12 is also attenuated. As the distance between the two permanent magnets 9 and 10 increases, the magnetic restoring force grows weaker, but these force progressions combine to yield a satisfactory switching feel or switching haptic.

In use, a magnet has an effect on the foil that is used in part to create the switch arrangement. The foil is made from a non-metallic material, the pathways are preferably copper or a non-magnetic material, so that the foil is not influenced by the magnet. According to the invention, an active body is arranged in the magnetic field of the magnet, and this may be constructed from a ferromagnetic material. The active body is arranged in the magnetic field of the magnet in such manner that the magnet is able to cause the foil to move. For example, the magnet is attracted by the active body, and in the process the magnet may draw the foil with it for a short distance, bringing it into contact with a counter contact. The active body and the magnet are then located on opposite sides of the foil from one another.

Thus, in the switch arrangement according to the invention an effect is created not mechanically on the foil or on another component attached to the foil, but with the aid of a magnet. Magnets may be of compact design, they function without wear, and yet still reliably cause a ferromagnetic active body to perform an approaching movement.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

For example, while the preferred embodiment described uses a permanent magnet as the active body, the active body may be made from any suitable magnetic material, including iron.

The invention claimed is:

1. A switch arrangement for electric currents, comprising:

at least two contacts to be closed and opened, one contact of the at least two contacts being formed by a section of an electrically conductive non-magnetic pathway of a foil, at least one magnet on one side of the foil; and at least one active body placeable in the magnetic field of the at least one magnet, wherein the active body is a magnetic component that is placeable facing the at least one magnet on the other side of the foil, and wherein the foil is made from a non-magnetic material and is deformable to allow the one contact to be moveable relative to another one of the at least two contacts.

2. The switch arrangement of claim 1, wherein the at least one magnet is a permanent magnet.

3. The switch arrangement of claim 2, wherein at least two magnets are provided, wherein at least one of the at least two magnets is arranged on each side of the foil, and wherein the polarities of the at least two magnets are aligned in the same direction.

4. The switch arrangement of claim 3, wherein at least one of the at least two magnets is accommodated displaceably in a sliding guide.

5. The switch arrangement of claim 4, wherein the sliding guide has a travel distance of ≥0.5 mm.

6. The switch arrangement of claim 4, wherein the at least two magnets are provided on at least one side of the foil, and these magnets are assigned to different switch circuits on the foil.

7. The switch arrangement of claim 6, wherein the sliding guide has a fixed housing and a slider that is displaceable inside the housing, wherein one slider permanent magnet is arranged in each of the housing and the slider, and these magnets have the same direction of polarity.

8. The switch arrangement of claim 7, wherein the polarity of the slider permanent magnet in the slider is aligned oppositely to the polarities of the magnets assigned to the foil.

9. The switch arrangement of claim 5, wherein the sliding guide has a fixed housing and a slider that is displaceable inside the housing, wherein one slider permanent magnet is arranged in each of the housing and the slider, and these magnets have the same direction of polarity.

10. The switch arrangement of claim 1, wherein both contacts are formed by sections of electrically conductive pathways within two foils and the two foils are arranged one on top of the other with an insulating gap between them.

11. The switch arrangement of claim 8, wherein both contacts are formed by sections of electrically conductive pathways within two foils and the two foils are arranged one on top of the other with an insulating gap between them.

12. The switch arrangement of claim 11, wherein the active body is a ferromagnetic material.

13. The switch arrangement of claim 1, wherein the active body is a ferromagnetic material.

14. A switch arrangement for electric currents, comprising:

at least two contacts to be closed and opened, one contact of the at least two contacts being formed by a section of an electrically conductive non-magnetic pathway of a foil, at least one magnet on one side of the foil; and at least one active body placeable in the magnetic field of the at least one magnet, wherein the active body is a magnetic component that is placeable facing the at least one magnet on the other side of the foil, wherein a sliding guide has a fixed housing and a slider that is displaceable inside the housing, wherein one slider permanent magnet is arranged in each of the housing and the slider, and these magnets have the same direction of polarity.

15. The switch arrangement of claim 14, wherein the polarity of the slider permanent magnet in the slider is aligned oppositely to the polarity of the at least one magnet assigned to the foil.

16. The switch arrangement of claim 15, wherein both contacts are formed by sections of electrically conductive pathways within two foils and the two foils are arranged one on top of the other with an insulating gap between them.

17. A switch arrangement for electric currents, comprising:

at least two pairs of contacts to be closed and opened, one of each pair of contacts being formed by sections of an electrically conductive pathway of a foil, a slider being moveable in a first direction;

at least one active body being accommodated in the slider; and at least two magnets respectively corresponding to the two pairs of contacts being provided on one side of the foil away from the slider, the at least two magnets being spaced from each other in the first direction;

wherein the slider is moveable between a first position where the active body is attracted to one of the at least two magnets to thereby force one of the at least two pairs of contacts to be closed and a second position where the active body is attracted to the other one of the at least two magnets to thereby force the other one of the at least two pairs of contacts to be closed.

18. The switch arrangement of claim 17, wherein the other one of the at least two pairs of contacts is open at the first position and one of the at least two magnets is open at the second position.

19. The switch arrangement of claim 17, further comprising a fixed housing, wherein the slider is displaceable inside the housing and one slider permanent magnet is arranged in each of the housing and the slider, and these magnets have the same direction of polarity.

20. The switch arrangement of claim 17, wherein the at least one active body is made of permanent magnet material, and magnetic fields of the at least one active body and magnets are aligned in the same direction.

* * * * *